United States Patent [19]

Fischer et al.

[11] Patent Number: 4,542,701

[45] Date of Patent: Sep. 24, 1985

[54] TAMPER-PROOF RAILROAD HOPPER CAR DOOR OPERATING SYSTEM

[75] Inventors: Robert T. Fischer, Homewood; Merle D. Wahlstrom, South Holland, both of Ill.

[73] Assignee: Miner Enterprises, Inc., Geneva, Ill.

[21] Appl. No.: 475,353

[22] Filed: Mar. 14, 1983

[51] Int. Cl.[4] ..... B61D 7/00; F15B 13/04

[52] U.S. Cl. ..... 105/240; 105/289; 105/308 R; 91/461

[58] Field of Search ..... 105/239, 240, 288, 289, 105/308 R, 311 R; 137/91; 91/426, 461

[56] References Cited

U.S. PATENT DOCUMENTS

| | | | |
|---|---|---|---|
| 1,481,787 | 1/1924 | Benbow | 91/461 |
| 3,178,886 | 4/1965 | Watson | 91/461 |
| 3,654,837 | 4/1972 | Knapp | 91/461 |
| 3,828,948 | 8/1974 | Peterson | 105/240 |
| 3,877,394 | 4/1975 | Schmeling | 105/240 |

FOREIGN PATENT DOCUMENTS

| | | | |
|---|---|---|---|
| 0184207 | 5/1955 | Fed. Rep. of Germany | 105/239 |
| 0524274 | 9/1921 | France | 105/240 |

OTHER PUBLICATIONS

NOPAK Publication, "Fluid Power Handbook", Dec. 1980.

Wabco Publication of Valve Types, Sep. 1981.

Miner Enterprises Brochure on AUTOMEC, "Air Cylinder Operated Mechanism . . . ", (undated).

Miner Enterprises Brochure on AUTOMEC, "Ideal for New Coal Cars . . . ", (undated).

Progressive Railroading Publication, "Quick Release Coal Car", Mar. 1982.

*Primary Examiner*—Robert B. Reeves

*Assistant Examiner*—Dennis C. Rodgers

*Attorney, Agent, or Firm*—Wood, Dalton, Phillips, Mason & Rowe

[57] ABSTRACT

A tamper-proof railroad hopper car door operating system for preventing operation of the doors when the auxiliary train line air pressure, and thus the locomotive engine, is removed. A directional control valve is provided through which air pressure is switched from the car reservoir pressure tank to control a door operating air cylinder. The control valve includes a pilot inlet connected to the auxiliary train line for supplying air pressure to switch the control valve, while the reservoir air pressure flows through the valve to supply the power medium for the air cylinder. In this manner when the auxiliary train line air pressure is removed, reservoir air pressure cannot be switched to move the hopper car door.

17 Claims, 5 Drawing Figures

TAMPER-PROOF RAILROAD HOPPER CAR DOOR OPERATING SYSTEM

BACKGROUND OF THE INVENTION

This invention generally relates to railroad car door operating systems, and more particularly relates to a method and apparatus for preventing the unauthorized operation of such car doors.

The present invention has particular utility when used in connection with railroad hopper cars equipped with bottom unloading features. In order to remove the labor involved in manually opening and closing the doors of a hopper-type railroad car, resort has been had to pneumatic-controlled apparatus for automatically opening and closing such doors in response to an externally generated command. A convenient source of power for these pneumatic devices is an auxiliary train line which couples air pressure from the locomotive engine in seriatim to each car in the train. Each railroad car is conventionally provided with a reservoir tank which is tapped into the auxiliary train line, for supplying air pressure to the pneumatic apparatus of that car, and to act as a buffer to reduce fluctuations in the auxiliary train line air pressure.

To further automate the procedure for quickly and automatically operating the hopper doors, the railroad car is in many cases provided with an electrical system which includes a pair of pick-up shoes on diagonally opposing corners of the car which contact wayside electrical rails. Engagement within the wayside rails will activate solenoids to operate a pneumatic directional control valve to either open or close the hopper car doors, depending on the polarity of the electrical source. For versatility, and sometimes by reason of necessity, the pneumatic directional control valve can also be manually actuated by push buttons.

To provide as secure a system as possible, these manual push buttons are enclosed in a lock box to prevent unauthorized operation, such as by vandals. It can be appreciated that an inordinate amount of labor and expense is involved when vandals break into the lock box, operate the push button and dump the load on the railroad tracks. By and large, the only way to clean up the cargo is by time consuming hand labor. Through experience it has been found that the unauthorized dumping of a hopper car seldom occurs when such cars of a train are connected to the locomotive. This is generally the case because the locomotive is continuously moving the cars on the track, or about a freight yard.

Vandalism frequently occurs, however, when a car or a connected string of cars are left unattended to be later moved and dumped. This situation presents an ideal target to vandals who break into the lock box, operate the push button and open the hopper doors through the use of the residual air pressure blocked in the reservoir tanks by check valves. While the air pressure of each reservoir tank could be drained to prevent the unauthorized operation of the hopper doors, such measures would be impractical as each reservoir would have to be pumped up on each reconnection to the locomotive, and the energy and time wasted over a period of time because of repeated pumpings would be significant.

From the foregoing, it is an object of the present invention to prevent the unauthorized unloading of fluid-activated hopper cars, without draining the fluid reservoir tank when such cars are disconnected from the primary source of air pressure, i.e., the locomotive.

It is a further object of the invention to prevent either the opening or the closing of the hopper doors for safety purposes, unless the locomotive is connected. In this manner, persons in and about an empty hopper car cannot be injured by a hopper door closing due to the operation of the manual push button.

Other objects and advantages will become apparent from the following description, taken in conjunction with the accompanying drawings.

SUMMARY OF THE INVENTION

In accordance with the invention, there is provided apparatus and methods for preventing the unauthorized operation of railroad car doors while such cars are disconnected from the locomotive source of air power, even though the reservoir tanks of each car may be capable of supplying air pressure to the pneumatic door operating mechanism.

A directional control valve is employed to direct air pressure from the reservoir tank to one inlet of a door operating air cylinder to extend the cylinder piston and open the hopper car doors, or to direct air pressure to another inlet of the cylinder to cause the doors to be moved to a closed position. The operation of the directional control valve itself to effect bidirectional cylinder piston movement is initiated in one instance by the external activation of manual "open" or "close" push bottons associated with the directional control valve. The external activation does not directly operate the control valve, but rather permits air pressure, via the auxiliary train line, to physically actuate the control valve internally to connect reservoir tank pressure to one or the other air cylinder inlets.

According to the invention the sources of air pressure required to operate the directional control valve to open or close the car doors are split. The source of air pressure in the auxiliary train line resulting from the connection to a locomotive engine is operative to operate the valve in response to the external activation of the push buttons. Once operated, the reservoir air pressure is directed through the appropriate control valve passageway to the air cylinder to force the piston in the direction corresponding to the pushing of either the "open" or "closed" push button.

In one embodiment of the invention an auxiliary control valve is responsive to the presence of air pressure in the auxiliary train line to permit the reservoir tank air pressure to be switched through a directional control valve and to one of the air cylinder inlets. In another embodiment, a single directional control valve has a pilot air input connected to the auxiliary train line so that the reservoir air pressure can be switched through the valve only when air pressure is present in the auxiliary train line.

Preferably, the air cylinder is of the double-action type, and there is provided both a solenoid and push button for actuating the control valve to move the air cylinder piston in one direction, and a solenoid and push button associated with moving the air cylinder piston in another direction. In this manner the car door can be opened or closed.

Since the directional control valve is operable only when air pressure is present in the auxiliary train line, the valve system of the present invention is effective to cause the car doors to be moved only when the railroad car is connected, via the auxiliary train line, to the locomotive power source or to some other external power source. When the railroad car is disconnected from the locomotive, it is assured that the contents of such car will not be dumped on the tracks by the unauthorized actuation of the valve push button.

BRIEF DESCRIPTION OF THE DRAWINGS

FIG. 4 is a pneumatic schematic of a conventional hopper car door operating system, retrofitted with a control valve receiving pilot air pressure from the auxiliary train line.

DETAILED DESCRIPTION OF THE INVENTION

Figure 1:
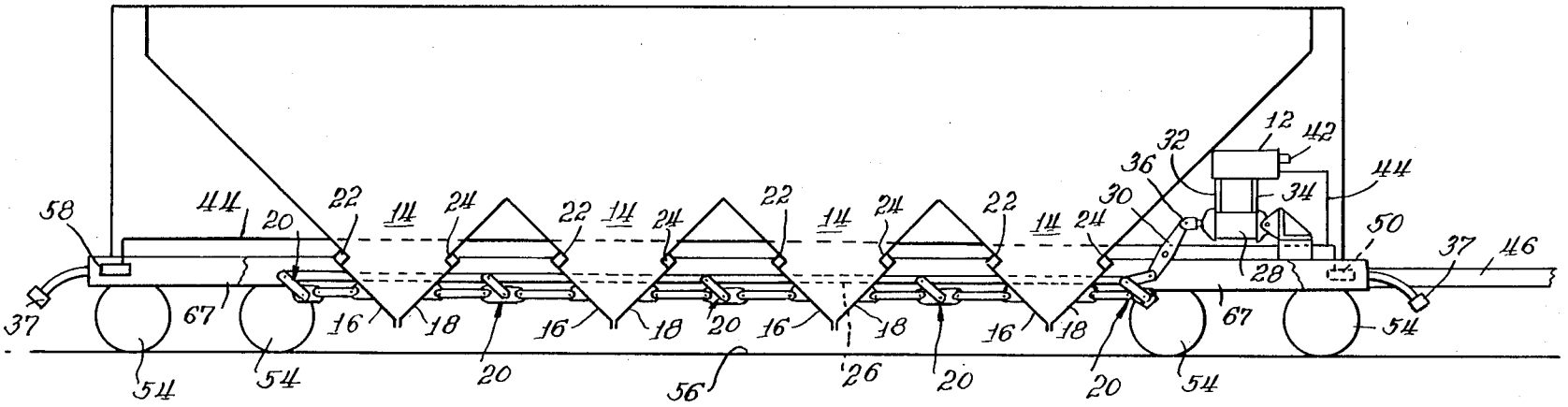
FIG. 1 is a simplified side view of a railroad hopper car having bottom doors operably interconnected by a linkage mechanism to an air cylinder, and controlled by a directional control valve according to the invention.

Referring generally to the drawings, the railroad hopper car embodying the features and advantages of the present invention is shown in FIG. 1, as reference character 10. While the invention will be described in terms of the railroad hopper car shown in FIG. 1, it should be realized that the principles of the invention may be applicable to other types of railroad cars. The primary source of fluid power of the exemplary railroad car is derived from a locomotive (not shown), and is generally in the nature of air pressure. However, the concepts of the present invention may be applied with equal advantage in those situations where the primary source of power is vacuum.

With specific reference to FIG. 1, the exemplary hopper car 10 includes a plurality of discharge pockets 14, each having at the converging bottom thereof a pair of doors 16 and 18 movable to discharge the cargo contained within the hopper car 10. The doors 16 and 18 are interconnected by a door operating assembly 20 which moves the doors about their respective hinges 22 and 24 in opposing directions. Each pair of hopper doors of the remaining plurality of pockets includes similar door operating linkage assemblies each of which is further interconnected and operated by a common axially movable connecting rod 26 extending essentially the length of the car. Not specifically shown is the crank and lever linkage assembly having an "over-center" locking feature which, when in the locked position, prevents the doors from being forced open by the pressure of the cargo.

An air cylinder 28, of the double-action type, is connected to the connecting rod 26 through a centrally journaled arm 30 which pivots in one direction to move the rod 26 and open all the hopper doors, and in another direction to close the doors. The air cylinder 28 has a first inlet port 34 through which air pressure is supplied from a directional control valve 12 to force the cylinder piston 36 outwardly to open the hopper pocket doors. Another inlet port 32 is comparably connected to the control valve 12 to retract the piston 36 within the cylinder 28 thereby closing all the hopper pocket doors.

Figures 3, 5:
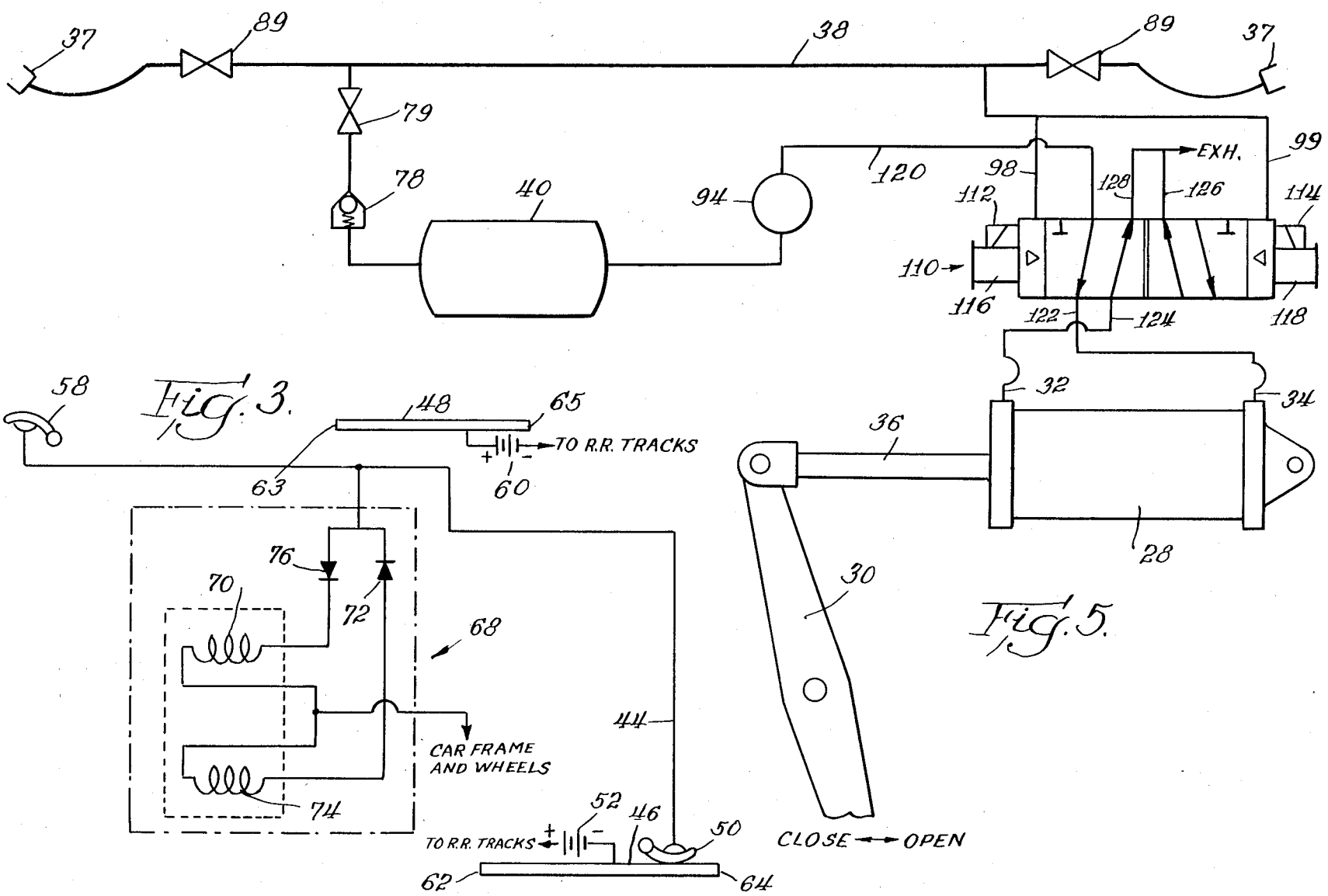
FIG. 3 is an electrical schematic showing the solenoid coils of the directional control valve and their respective connections to the wayside rail pick-up shoes.
FIG. 5 is a pneumatic illustration of the air cylinder directional control valve, with an air pilot input connection to the auxiliary train line and with another input connection to the reservoir pressure tank.
Figure 11:
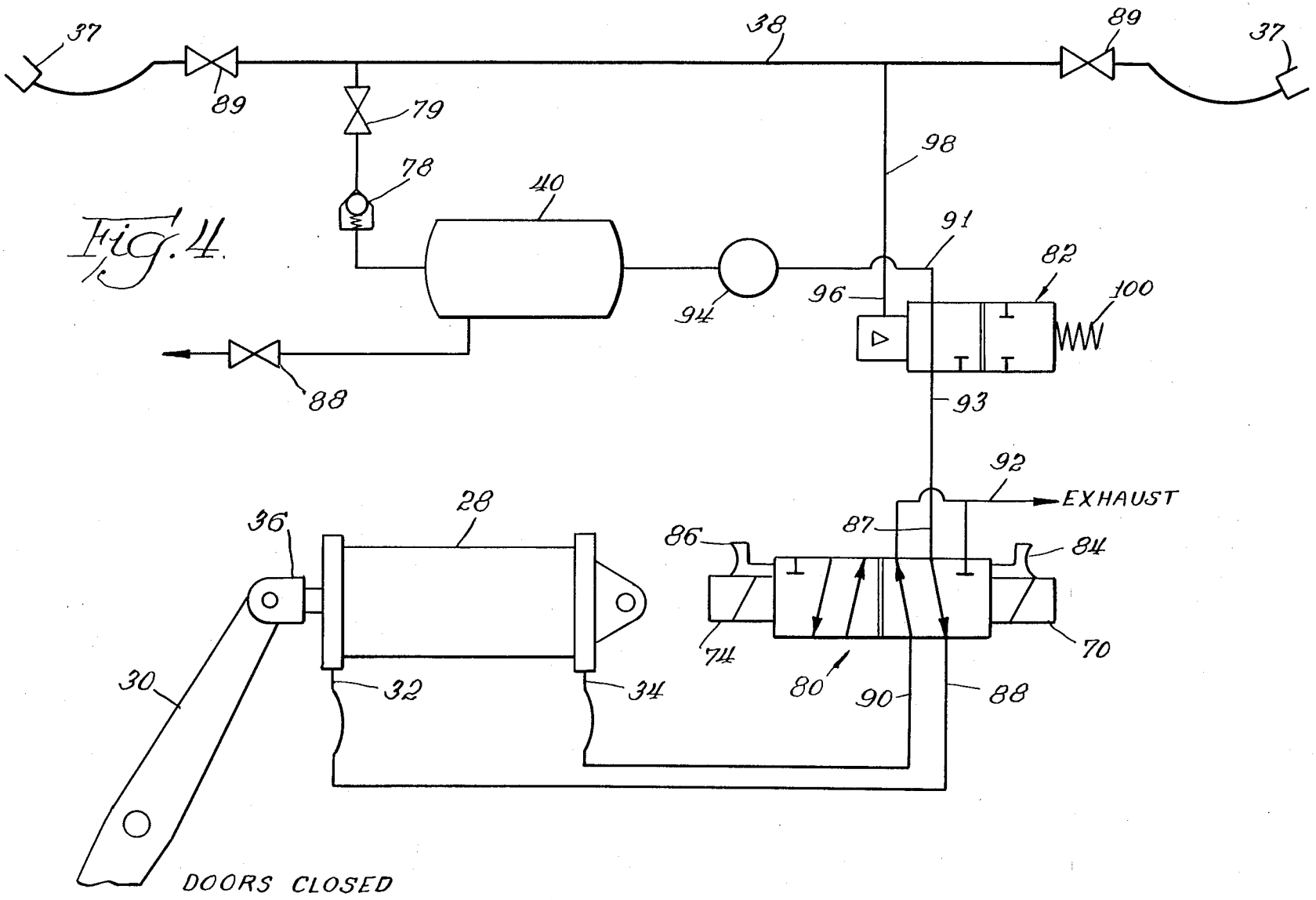

With reference to FIG. 1 together with FIGS. 3 and 4, there is shown the railroad hopper car 10 which includes fore and aft couplers 37 for connecting the primary source of air pressure from the locomotive through the auxiliary train line 38 to the cars with which it is coupled. In a conventional manner, air pressure is tapped off the auxiliary train line 38 to an intermediate reservoir tank 40. The reservoir tank 40 acts as a buffer between the auxiliary train line 38 and the pneumatically controlled door operator, thereby reducing fluctuations of air pressure within the auxiliary train line 38.

Figure 2:
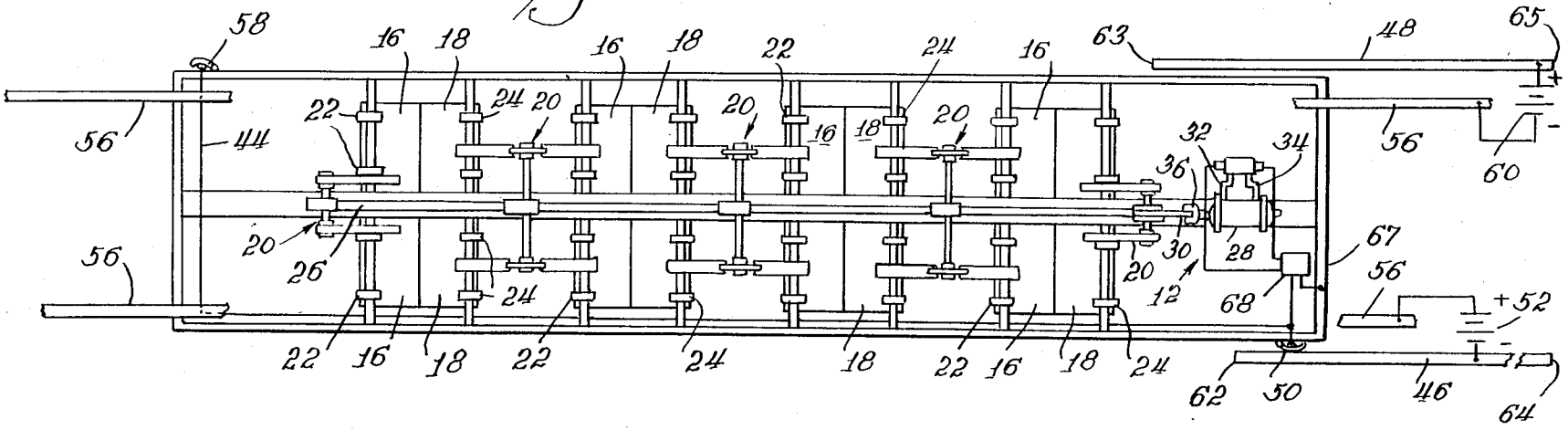
FIG. 2 is a bottom view of a railroad hopper car showing the displacement of the wayside electrical rails for actuating the directional control valve solenoid to open the doors and dump the cargo at a particular location along the track, and thereafter to close the doors. The car frame and wheels are not shown.

The directional control mechanism, generally designated 12 in FIG. 1 is of the type having a manual push button control 42, as well as an electrical solenoid control 68 for actuating the valve mechanism to direct air pressure to one or the other inlet ports 32 or 34 of the air cylinder 28. While the principles of the present invention may find application with the use of only the manual control 42, FIG. 2 illustrates a preferred embodiment which employs wayside electrical rails 46 and 48 which are effective in actuating solenoids in the directional control valve mechanism 12 to dump the cargo without the intervention of manual labor.

The electrical solenoid circuit is shown in more detail in FIG. 3. In general, however, and as shown in FIGS. 2 and 3, one pick-up shoe 50 completes the electrical circuit through the battery 52, one solenoid winding 74 and diode 72 of the solenoid circuit 68, the car frame 67, wheels 54, wheel tracks 56, and back to the other terminal of the battery. The other pick-up shoe 58 has comparable connections through the other control valve solenoid winding 70 and diode 76 to another battery 60, of reverse polarity. Each of the pick-up shoes 50 and 58 are particularly positioned along the sides of the hopper car, and the wayside rails 46 and 48 have respective initial contact points 62 and 63, and end contact point 64 and 65, for timing the energized state of the solenoids. With this construction, the doors of the hopper car 10 which is moving to the right on the tracks 56 of FIG. 2 are automatically opened when shoe 50 initially contacts wayside rail 46, and are subsequently automatically closed when pick-up shoe 58 contacts rail 48. The pick-up shoes 50 and 58 are thus particularly located on the car so as to prevent contact with their respective wayside rails at the same time as this would result in an ambiguous state of door movement.

FIG. 3 is an electrical schematic of a circuit adapted for electrically actuating the tamper-proof door moving system according to the present invention. When it is intended to automatically operate the hopper car doors to discharge the cargo, one expedient method is the wayside rail structure as discussed above. The wayside rail system may typically be employed on a trestle where the cargo of each car is automatically dumped while the string of cars is moved by a locomotive through the wayside rail system.

It can be visualized from FIG. 3 that as the hopper car is pulled along the load bearing tracks 56, shoe 50 makes initial contact with wayside rail 46 thereby completing the electrical circuit of battery 52 through windings 74 of the solenoid to open the hopper car doors. The voltage magnitude of battery 52 corresponds to the voltage at which the solenoids are rated. Particularly, once the shoe 50 and rail 46 make sliding contact, current flows out of the positive terminal of battery 52 through the steel railroad tracks 56, the hopper car wheels 54, the solenoid winding 74 circuit comprising the solenoid circuit shown generally as reference character 68. From the solenoid winding circuit 68 the current returns to the battery 52 negative terminal via common conductor 44, through the shoe 50 and wayside rail 46. Within the solenoid winding circuit 68 the current flow from battery 52 is steerred through solenoid winding 74 by forward-biased diode 72 thereby actuating the solenoid to open the hopper doors. Stated another way, battery 52 current cannot flow through solenoid winding 70 as diode 76 is back-biased and thus current flow through it, in a direction against the arrow of the diode symbol, is prevented.

While the dual battery and diode circuit of FIG. 3 serve to energize solenoid coils 70 and 74 in a timed relationship to respectively close and open the hopper pocket doors, alternative arrangements may be equally advantageous. For example, a single shoe and battery may be used with the side rails on the same side, and with means for switching the battery polarity when the shoe contacts one rail and then the other. With this alternate construction, the same result is achieved as before described.

The length of rail 46, and the speed of the hopper car as it is pulled along the tracks are chosen such that the cargo of the car is completely unloaded by the time pick-up shoe 58 contacts wayside rail 48, whereupon electrical current from battery 60 flows through diode 76 and solenoid winding 70 to close the hopper car doors.

With this background, the first illustrated embodiment of the tamper-proof door operating system according to the invention, as shown in FIG. 4, will be more easily understood. This simplified schematic form set forth in FIG. 4 illustrates the hopper car auxiliary train line 38 supplying the primary source of locomotive air pressure to the hopper car pneumatic door operator through a buffer reservoir tank 40. A conventional check valve 78 prevents the air pressure within the reservoir 40 from re-entering the auxiliary train line 38 once the locomotive engine is disconnected from the cars.

Internally piloted directional control valve 80 is disposed between the reservoir supply of air pressure 40 and the air cylinder 28 to control the application of air pressure to either inlet port 32 or 34 and thereby control the respective closing or opening of the hopper car doors. According to one embodiment of the invention, auxiliary valve 82 is placed in series between the reservoir 40 and the conventional directional control valve 80. Shut off valves 79 and 89, filter 94, and drain valve 88 illustrated in the drawings are standard fluid circuit components and are shown for the sake of completeness.

The directional control valve 80 is responsive to external actuation, in the nature of manual pressure applied to push buttons 84 or 86, or solenoids 70 or 74, to switch the valve and direct air pressure from the inlet port 87 to one of the outlet ports 88 or 90, and thereby cause the closing or opening of the hopper doors, respectively.

The position of the air cylinder piston 36 as shown in FIG. 4 is retracted and corresponds to the hopper car doors being closed. This is the case as it is seen that the air pressure from the reservoir 40 is directed through the auxiliary valve 82 to the directional control valve inlet port 87, then redirected internally to the valve outlet port 88 and to the air cylinder inlet 32. The piston 36 of the double-action air cylinder 28 is forced inwardly to a retracted position (rightward in FIG. 4) when air pressure is supplied to its inlet 32, and residual air on the other side of the cylinder piston is forced out of port 34 into directional control valve port 90, and finally exhaust to the atmosphere through exhaust port 92.

When the hopper car 10, or a group of such cars, is disconnected from the locomotive and thus from the primary source of air pressure, the reservoir tank 40 usually acts as a secondary source of air pressure and permits the directional control valve 80 to be operated upon being externally actuated, such as by pushing one of the buttons 84 or 86.

As noted above, one shortcoming of this usual arrangement is that sufficient air pressure remains in the reservoir 40 to operate the air cylinder 28 in response to an unauthorized actuation of the push button 86 and dump the cargo at an undesired location. To reiterate, this occurrence could be prevented by releasing the reservoir air pressure by drain valve 88, but this solution is undesirable as the reservoir air pressure must be replenished by the locomotive engine upon reattachment to the auxiliary train line. It can be appreciated that a significant amount of air pressure is required to replenish each reservoir tank 40 in, for example, a one hundred hopper car train.

In accordance with the present invention it is of great practical importance to guard against the operation of the directional control valve 80 in the absence of air pressure in the auxiliary train line 38. To that end, auxiliary control valve 82 can be retrofitted into the conventional directional control valve system heretofore employed in hopper cars for manually or automatically opening and closing the car doors. The auxiliary control valve 82 of FIG. 4 senses the presence of air pressure in the auxiliary train line 38. If such air pressure exists, a through connection is caused by the valve 82 to be established between the reservoir 40, inlet 91, outlet 93 and the directional control valve inlet 87. Thus, whenever the locomotive engine is connected to the train of hopper cars, the operation of the directional control valve 80 is unimpeded by auxiliary valve 82, under such conditions, the hopper car doors can be operated manually by push buttons 84 and 86, or solenoid-operated by the wayside rail and pick-up shoe arrangement discussed above. When, however, the locomotive engine is disconnected from the train of hopper cars, the auxiliary control valve 82 is of the type which automatically interrupts the flow of air pressure from the reservoir 40 to the directional control valve 80. The operation of the air cylinder 28, and thus the movement of the hopper doors is prevented.

In the embodiment depicted in FIG. 4, the auxiliary control valve 82 is a two-way, two-position valve with an internal plunger actuated by pilot air from the auxiliary train line 38. The auxiliary control valve 82 is shown schematically having an input line 91 and one output 93. Pilot air pressure is connected from the auxiliary train line 38 to the pilot air port 96 by way of pilot air line 98. In the presence of air pressure in the auxiliary train line 38, pilot air pressure actuates the auxiliary valve 82, moves an internal plunger (not shown) against the spring 100, and effects a through connection between input line 91 and output line 93. Reservoir air pressure is thereby supplied to the directional control valve 80.

In the absence of air pressure in the auxiliary train line 38, the source of pilot air to the auxiliary control valve 82 is removed. The spring 100 then urges the internal valve plunger to an opposing position, thereby interrupting and disconnecting the reservoir air pressure from the directional control valve 80. In this configuration, it is seen by the schematic representation of the control valve 82 that, despite the fact that air pressure is present in the reservoir tank 40, the input line 91 is disconnected from the outlet line 93 thereby preventing the passage of air pressure therethrough to the air cylinder 28. It should be realized that the pilot air line 98 supplies air pressure only to the pilot actuating assembly of the auxiliary control valve 82, and is not connected by passageways within such valve to supply pilot air pressure to any of its outlet ports. Also, in the absence of air pressure in the auxiliary train line 38, the check valve 78 prevents reservoir air pressure from reverse flowing into the pilot air line 98, should the auxiliary train line 38 shutoff valves 87 and 89 be closed.

From the arrangement just described, it is seen that the auxiliary control valve 82 can be retrofitted into an existing air pressure operable hopper car door system to prevent the operation of the doors in the absence of air pressure in the auxiliary train line 38.

The principles of the present invention are embodied in another form as shown in FIG. 5 of the drawings. In this second embodiment, a four-way two-position air valve, generally designated 110, replaces the auxiliary control valve 82 and directional control valve 80 of the embodiment shown in FIG. 4. This valve can be conventionally actuated by electrical solenoids in conjunction with the pick-up shoes and wayside rails as before described, to supply air pressure to either cylinder input port 32 or 34 to respectively close or open the hopper car doors.

The directional control valve 110 of FIG. 5 includes pilot supply air lines 98 and 99 connected between the valve 110 and the auxiliary train line 38 for operating the valve in response to externally generated solenoid signals or pressure on the push buttons 116 and 118. The external actuation of this directional control valve 110 does not cause displacement of its internal plunger (not shown) directly, but rather permits the force of primary air pressure in the pilot line 98 to act upon the plunger and move it in one direction in response to the actuation of solenoid 112 or push button 116, or air pressure in line 99 to act upon the plunger and move it in the other direction in response to the actuation of solenoid 114 or push button 118. The schematic of FIG. 5 shows the directional control valve 110 after having been actuated by either solenoid 112 or push button 116 the result of which effects an internal through connection in the valve 110 between inlet supply line 120 and outlet 122. This through connection permits secondary air pressure from the reservoir tank 40 to be applied to the air cylinder input port 34, thereby extending the piston 36 out of the cylinder and opening the hopper car doors. Within the air cylinder 28 the air pressure on the other side of the piston is released through outlet 32, directed to the directional control valve port 124, and exhausted to the atmosphere through port 128.

It can be visualized from the schematic representation of the directional control valve 110 that if it is desired to close the cargo doors by the actuation of the push button 118 or solenoid 114, air pressure derived from the secondary source, i.e., the reservoir tank 40, is applied through the valve 110 to the air cylinder port 32, thereby causing the piston 36 to be retracted inwardly to close the hopper car doors. Residual air on the other side of the piston is comparably forced out of air cylinder port 34 and exhaust to the atmosphere through directional control valve outlet 126.

As in the other embodiment discussed above, the directional control valve 110 is operable only by the presence of air pressure in the pilot lines 98 and 99 which necessitates the connection of the hopper car auxiliary train line 38 to the locomotive engine or some other external source of air pressure. In the absence of air pressure in the auxiliary train line 38 the manual push buttons 116 and 118, or the solenoids 112 and 114 may be operated with no effect on the displacement of the plunger therein, and thus with no effect on the movement of the hopper car doors. As a result, and in keeping with the invention, the disconnection of the hopper car 10 from the primary source of air pressure (the locomotive engine) prevents the hopper doors from being either opened or closed. This feature of the invention enhances the safety aspect of a disconnected hopper car insofar as an empty car having its bottom doors open cannot be closed upon a person's arms or legs by the intentional or inadvertent pushing of the buttons.

While the preferred embodiments of the apparatus have been disclosed with reference to specific valve structures, it is to be understood that many changes in detail may be made as a matter of engineering choice without departing from the scope of the invention as defined by the appended claims. Indeed, those skilled in the art may prefer to utilize apparatus other than the disclosed valves to sense the presence of air pressure in the auxiliary train line and prevent the operation of the directional control valve in the absence of such pressure. Also, it may be desired to operate mechanisms other than hopper car doors, as this may be had simply by connecting such mechanisms to the air cylinder piston. In this regard, the functional operation of the present invention has been described in connection with hopper car doors, not by way of necessity, but rather to illustrate the concepts of the invention.

What is claimed is:

1. In a door operating and control system, the improvement comprising: a line for providing a primary source of fluid power, a door through which cargo is unloaded, means responsive to fluid power for moving said door, a reservoir connected to said line for providing a secondary source of fluid power, means for preventing the flow of fluid power from said reservoir back to the primary line source, and a control valve system responsive to external actuation for connecting said secondary source of fluid power to the door moving means for causing movement of said door, the control valve system including means for disconnecting said secondary source of fluid power from the door moving means in response to the absence of fluid power in said primary source.

2. The improved door operating and control system of claim 1 wherein said control valve system includes electrical means responsive to an electrical signal for actuating said valve system in the presence of fluid power in said primary source.

3. The improved system of claim 1 or 2 wherein said control valve system includes manual means responsive to manual pressure for actuating said valve system in the presence of fluid power in said primary source.

4. In a railroad car door operating and control system, the improvement comprising: an auxiliary train line for providing a primary source of fluid power; a door through which cargo is unloaded; moving means responsive to fluid power for opening and closing said cargo door; a reservoir connected to said auxiliary train line for providing a secondary source of fluid power; means for preventing the flow of fluid power from said reservoir back to the primary line source, a directional control valve responsive to a first and second external actuation for connecting said secondary power source to said moving means to respectively open and close said door, and an auxiliary valve connected to said reservoir and having an open and closed state and through which fluid power is supplied to said directional control valve in said open state, said auxiliary valve including means responsive only to the presence of fluid power in said auxiliary train line for opening said auxiliary valve and preventing opening of the auxiliary valve in the absence of fluid power in the auxiliary train line.

5. The improved railroad car door system of claim 4 wherein said means responsive to the presence of fluid power includes pilot means connected to said auxiliary train line for operating said auxiliary valve for effecting a connection therethrough of said secondary fluid power to said directional control valve.

6. The improved railroad car system of claim 4 or 5 further including means for automatically returning said auxiliary valve to said closed state in the absence of fluid power in said auxiliary train line.

7. In a railroad car or the like with a door movable to discharge cargo from said car, a tamper-proof movement control system comprising:

a primary source of fluid power connectable to said car;

a reservoir for supplying fluid power to said car when said primary source of power is removed from said car;

fluid cylinder means operably connected to said door for moving said door; and an actuatable fluid valve interposed between said reservoir and said cylinder means for selectively connecting and disconnecting the fluid power from said reservoir to said cylinder means, said fluid valve including means responsive to the presence of fluid power in both said primary source and said reservoir for connecting the fluid power therethrough from said reservoir to said cylinder means to thereby move said door and for disconnecting the fluid power from the reservoir in response to the absence of fluid power in said primary source.

8. The railroad car door control system of claim 7 wherein said fluid valve further includes means responsive to the absence of fluid power in said primary source for disconnecting the fluid power from said reservoir to said cylinder means.

9. The railroad car door control system of claim 7 further including means responsive to an electrical signal for actuating said fluid valve.

10. The railroad car door control system of claim 7 or 9 further including manual means for actuating said fluid valve.

11. The railroad car door control system of claim 7 wherein said fluid valve includes means for connecting the fluid power of said reservoir to said cylinder means and maintaining said connection during the absence of fluid power in said primary source.

12. In a railroad hopper car or the like with a door movable to discharge cargo contained in said car, a tamper-proof door control system for preventing unauthorized discharge of said cargo, comprising:

an auxiliary train line having a primary source of air pressure;

a reservoir for supplying air pressure to said car when the primary source in said auxiliary train line is removed therefrom;

a double action air cylinder operatively connected to said door, with a first port into which air pressure is applied to open said door, and a second port into which air pressure is applied to close said door;

a pilot actuated directional control valve including (a) an input port connected to said reservoir through which air pressure is supplied to said control valve;

(b) a pair of output ports each connected to a different one of said air cylinder ports;

(c) pilot means responsive to external actuation and responsive to the presence of air pressure in said auxiliary train line for selectively connecting said input port to a desired output port thereby effecting the opening or closing of said door;

(d) whereby, when air pressure is removed from said auxiliary train line said pilot means is ineffective to change the connection between the input port and output ports and thus move the door to another position.

13. The improved railroad car door system of claim 9 further including a wayside rail system through which said railroad car is moved, said rail system including an electrical signal source for generating a signal, and contact means for coupling said signal to the door control system of said railroad car.

14. The improved railroad car door system of claim 13 wherein said electrical signal source includes means for providing a signal of one polarity for actuating said fluid valve wherein said door is moved in one direction, and for providing another polarity for actuating said fluid valve wherein said door is moved in another direction.

15. The improved railroad car door system of claim 14 wherein said electrical signal source comprises a battery, and said signal source further includes means for switching the battery polarity so as to provide two signals for actuating said door control system to move said door.

16. A method of preventing unauthorized movement of a door in a railroad car or the like having movable doors and being of the type having a fluid power reservoir, a auxiliary train line for supplying fluid power to said car through said reservoir, fluid cylinder means for moving said doors, and externally actuatable control valve means interposed between said reservoir and said cylinder means for selectively applying reservoir fluid power to said cylinder means in response to external actuation, said method comprising the steps of:

sensing the presence of fluid power in said auxiliary train line; and preventing the application of reservoir fluid power to said cylinder means upon the absence of fluid power in said auxiliary train line despite external actuation of said control valve;

whereby unauthorized movement of said door is prevented when fluid power is removed from said auxiliary train line.

17. The method of preventing unauthorized movement of a railroad car door of claim 16 wherein said sensing step comprises using a fluid directional control valve with a pilot supply inlet and coupling said inlet to said auxiliary train line.

* * * * *